US011193650B2

(12) United States Patent
Yang

(10) Patent No.: US 11,193,650 B2
(45) Date of Patent: Dec. 7, 2021

(54) LENS AND ILLUMINATING DEVICE EMPLOYING THE SAME

(71) Applicant: OPPLE LIGHTING CO., LTD., Shanghai (CN)

(72) Inventor: Jing Yang, Shanghai (CN)

(73) Assignees: Opple Lighting Co., Ltd., Shanghai (CN); Suzhou Opple Lighting Co., Ltd., Suzhou (CN)

( * ) Notice: Subject to any disclaimer, the term of this patent is extended or adjusted under 35 U.S.C. 154(b) by 0 days.

(21) Appl. No.: 16/661,594

(22) Filed: Oct. 23, 2019

(65) Prior Publication Data

US 2020/0056758 A1 Feb. 20, 2020

Related U.S. Application Data

(63) Continuation of application No. PCT/CN2018/081617, filed on Apr. 2, 2018.

(30) Foreign Application Priority Data

Apr. 26, 2017 (CN) ..... 201710283117.9
Apr. 26, 2017 (CN) ..... 201720451785.3

(51) Int. Cl.
*F21V 1/00* (2006.01)
*F21V 5/04* (2006.01)
(Continued)

(52) U.S. Cl.
CPC ..... *F21V 5/04* (2013.01); *F21S 8/06* (2013.01); *F21V 3/02* (2013.01); *F21V 7/04* (2013.01);
(Continued)

(58) Field of Classification Search
CPC ..... F21V 5/04; F21V 3/02; F21V 7/04; F21V 13/04; F21V 7/0091; F21V 5/046;
(Continued)

(56) References Cited

U.S. PATENT DOCUMENTS 7,258,457 B2 * 8/2007 Tenmyo ..... G02B 3/0087 362/16
9,416,951 B1 8/2016 Householder
(Continued)

FOREIGN PATENT DOCUMENTS

CN 104676473 A 6/2015
CN 204678097 U 9/2015
(Continued)

OTHER PUBLICATIONS

IP.com translation of EP 2910844 B1 (Year: 2017).*
(Continued)

*Primary Examiner* — William J Carter
*Assistant Examiner* — Omar Rojas Cadima
(74) *Attorney, Agent, or Firm* — Arch & Lake LLP

(57) ABSTRACT

The present disclosure provides a lens and an illuminating device employing the same. The lens is an extendable lens, and includes a light incident surface, a light emitting surface, and a first reflecting surface and a second reflecting surface disposed on two sides of the light incident surface respectively. Light enters the lens from the light incident surface at least includes: a first part which is reflected by the second reflecting surface and then directly emits from the light emitting surface, and a second part which is reflected to the second reflecting surface by the first reflecting surface, reflected by the second reflecting surface, and then emits from the light emitting surface.

17 Claims, 9 Drawing Sheets

(51) Int. Cl.

| | |
|---|---|
| ***F21S 8/06*** | (2006.01) |
| ***F21V 3/02*** | (2006.01) |
| ***F21V 7/04*** | (2006.01) |
| ***F21V 13/04*** | (2006.01) |
| ***F21V 17/12*** | (2006.01) |
| *F21Y 103/33* | (2016.01) |

(52) U.S. Cl.
CPC ..... *F21V 13/04* (2013.01); *F21V 17/12* (2013.01); *F21Y 2103/33* (2016.08)

(58) Field of Classification Search
CPC .... F21V 5/08; F21Y 2103/33; F21Y 2113/13; G02B 19/0028; G02B 3/06; F21S 8/026; F21S 8/04; F21S 8/06
See application file for complete search history.

(56) References Cited

U.S. PATENT DOCUMENTS 10,480,721 B2 * 11/2019 Seki ..... G02B 19/0014
2015/0183525 A1 * 7/2015 Jager ..... G02B 3/08 340/983
2016/0040845 A1 * 2/2016 Kuo ..... F21S 43/243 362/518
2017/0059131 A1 3/2017 Hyun
2017/0074462 A1 * 3/2017 Jiang ..... F21K 9/238

FOREIGN PATENT DOCUMENTS

CN 105318275 A 2/2016
CN 206072988 U 4/2017
CN 106895326 A 6/2017
CN 206682771 U 11/2017
EP 2910844 B1 * 1/2017 ..... F21V 7/0091

OTHER PUBLICATIONS

International Search Report (including English translation) and Written Opinion issued in PCT/CN2018/081617, dated Jun. 28, 2018, 14 pages.

* cited by examiner

LENS AND ILLUMINATING DEVICE EMPLOYING THE SAME

CROSS-REFERENCE TO RELATED APPLICATIONS

This application is based upon and claims the priority of PCT patent application No. PCT/CN2018/081617 filed on Apr. 2, 2018 which claims the priority of Chinese Patent Application No. 201710283117.9 filed on Apr. 26, 2017, and Chinese Patent Application No. 201720451785.3 filed on Apr. 26, 2017, the entire content of all of which is hereby incorporated by reference herein for all purposes.

TECHNICAL FIELD

The present disclosure belongs to the technical field of illumination, and particularly relates to a lens and an illuminating device employing the same.

BACKGROUND

As a light distribution element, lens is widely used in illuminating devices. In specific application, the lens is required to have both of large emission angle and uniform light emission.

SUMMARY

The present disclosure provides a lens, an illuminating device and a method of utilizing a lens.

The present disclosure provides a lens. The lens may be an extendable lens and may includes: a light incident surface, a light emitting surface, and a first reflecting surface and a second reflecting surface disposed on two sides of the light incident surface respectively. Light that enters the lens from the light incident surface at least may include: a first part which is reflected by the second reflecting surface and then directly emits from the light emitting surface; and a second part which is reflected to the second reflecting surface by the first reflecting surface, then reflected by the second reflecting surface, and then emits from the light emitting surface.

The present disclosure also provides an illuminating device. The device may include a base, a first light source component and a second light source component that are both fixed on the base, a first light distribution element disposed above the first light source component, a second light distribution element disposed above the second light source component, and a mounting cover connected with the base.

The second light distribution element may include at least one section of the lens, where the lens is an extendable lens, and may include a light incident surface, a light emitting surface, and a first reflecting surface and a second reflecting surface disposed on two sides of the light incident surface, where light that enters the lens from the light incident surface may at least include: a first part which is reflected by the second reflecting surface and then directly emits from the light emitting surface, and a second part which is reflected to the second reflecting surface by the first reflecting surface then reflected by the second reflecting surface and then emits from the light emitting surface.

The device may also include an area covered by emergent light of the second light source component after light distribution and an area covered by emergent light of the first light source component after light distribution are different areas.

The present disclosure further provides a method of utilizing a lens that is extendable. The method may include providing a light incident surface and a light emitting surface; and disposing a first reflecting surface and a second reflecting surface on two sides of the light incident surface; and when light enters the lens from the light incident surface, reflecting a first part of the light by the second reflecting surface and then directly emitting from the light emitting surface, and reflecting a second part of the light to the second reflecting surface by the first reflecting surface then by the second reflecting surface and then emitting from the light emitting surface.

It is to be understood that both the foregoing general description and the following detailed description are exemplary and explanatory only and are not restrictive of the present disclosure.

BRIEF DESCRIPTION OF THE DRAWINGS

The drawings described herein are intended to provide a further understanding of the present disclosure and constitute one part thereof. The illustrative examples of the present disclosure and the description thereof are used for explaining the present disclosure and do not constitute any inappropriate limitation of the present disclosure.

DETAILED DESCRIPTION

Figure 1:
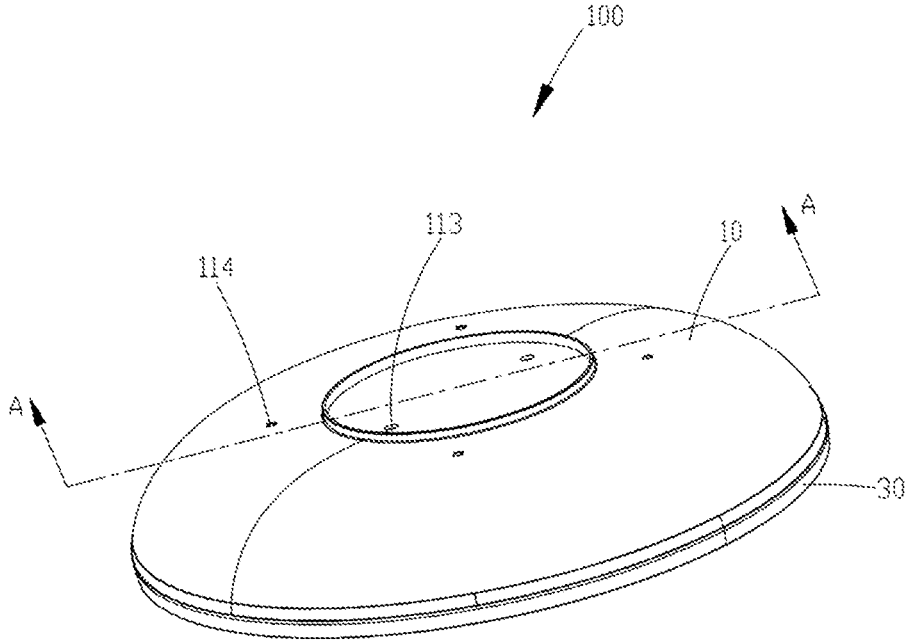
FIG. 1 is an elevation view of an illuminating device provided by the present disclosure.
Figure 2:
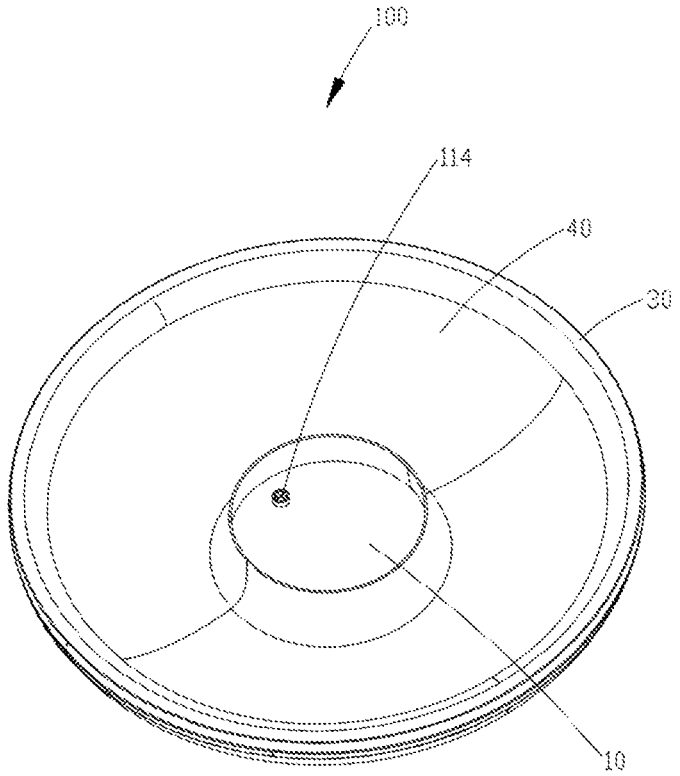
FIG. 2 is an elevation view of FIG. 1 from another perspective.

In order to make objects, technical details and advantages of the examples of the disclosure apparent, the technical solutions of the examples will be described in a clearly and fully understandable way in connection with the drawings related to the examples of the disclosure. Apparently, the described examples are just a part but not all of the examples of the disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

Some lens in illuminating devices may be limited by its own shape and material properties. As a result, light emitted by a light source, after being subject to a secondary light distribution of the lens, may have a small polarization angle, which results in that a propagation distance of the light may not be long enough and a light uniformity is poor.

Ceiling lamp is one kind of illuminating device, and generally includes a base, a light source module and a driving power supply module both accommodated in the base, a light distribution element disposed outside the light source module, and a cover mask connected with the base, among which the light distribution element is configured to distribute light for the light source module and is mostly implemented in a lens. Usually, the ceiling lamp may only adopt one type of light source as a main lighting component, and may directly provide light in a downward direction. In some scenes, in addition to realize a main lighting function in the downward direction, the ceiling lamp may also be required to realize an auxiliary lighting function for lighting the ceiling, also known as semi-direct lighting.

One solution for such semi-direct lighting is to adopt one type of light source and to use both a top surface and a side surface of the cover mask as light emitting surfaces. There are following two drawbacks involved in such semi-direct lighting: firstly, the propagation distance of the light emitted from the side surface is too short, and bright spots are only formed around the ceiling lamp; secondly, when only a separate direct lighting function or a separate ceiling lighting function is required, such semi-direct lighting method cannot meet the demands.

As illustrated in FIGS. 1 to 7, the present example provides an illuminating device 100, including a base 30, a light source module 20 fixed on the base 30, a first light distribution element 40 and a second light distribution element 50 both disposed on the light source module 20, and a mounting cover 10 connected with the base 30. More specifically, the light source module 20 includes a first light source component 21 and a second light source component 22. The first light distribution element 40 is configured to perform secondary light distribution on light emitted by the first light source component 21. The second light distribution element 50 is configured to perform secondary light distribution on light emitted by the second light source component 22. An area covered by emergent light of the second light source component 22 after light distribution and an area covered by emergent light of the first light source component 21 after light distribution are two different areas. The illuminating device 100 provided by the present disclosure may serve as a ceiling lamp to be mounted on the ceiling (not illustrated), and can provide light upwards and downwards; for example, the first light source component 21 provides light downwards, and the second light source component 22 provides light towards the ceiling.

Detailed description will be given below to the components and elements in the illuminating device 100 provided by the example of the present disclosure, as well as the connection relationships between the components and elements.

Figure 3:
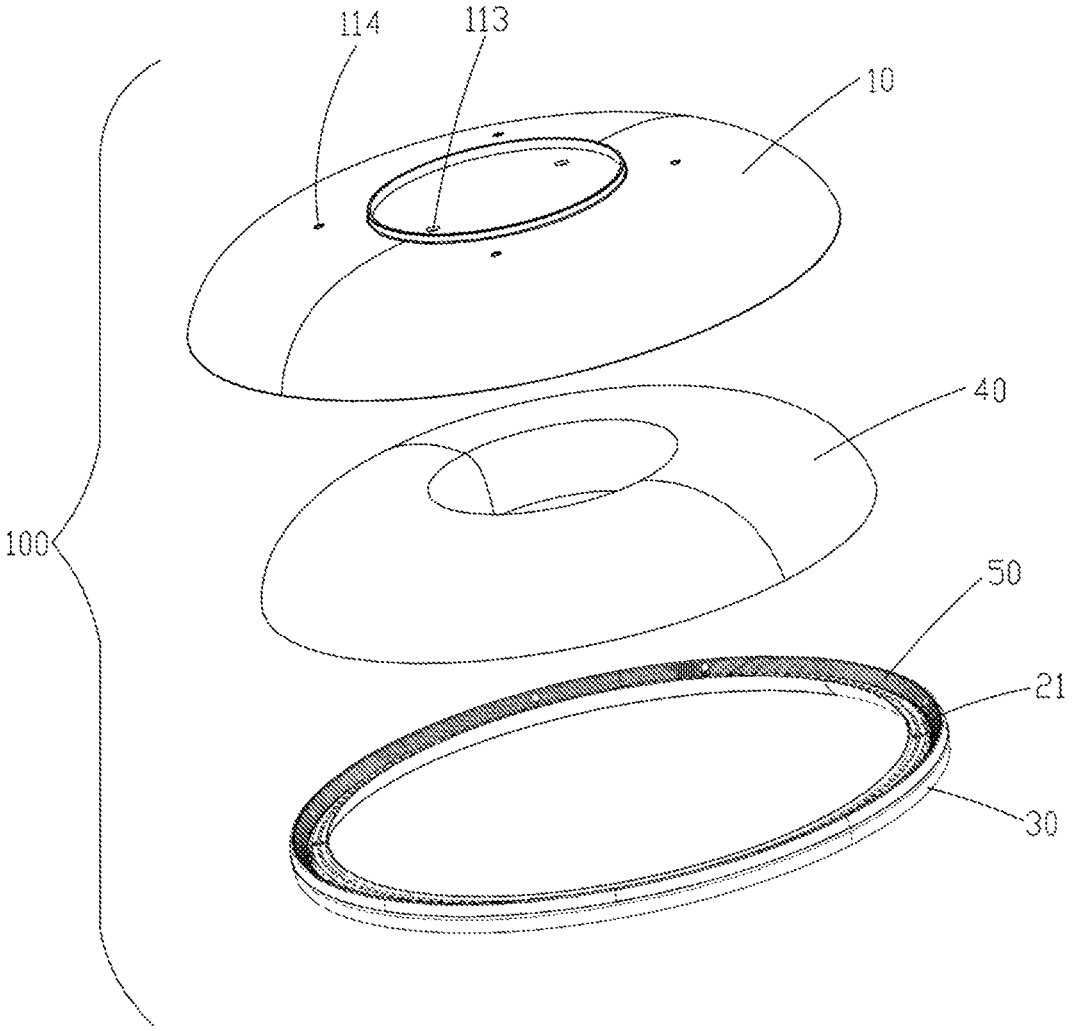
FIG. 3 is a partially exploded view of an illuminating device provided by the present disclosure.
Figure 4:
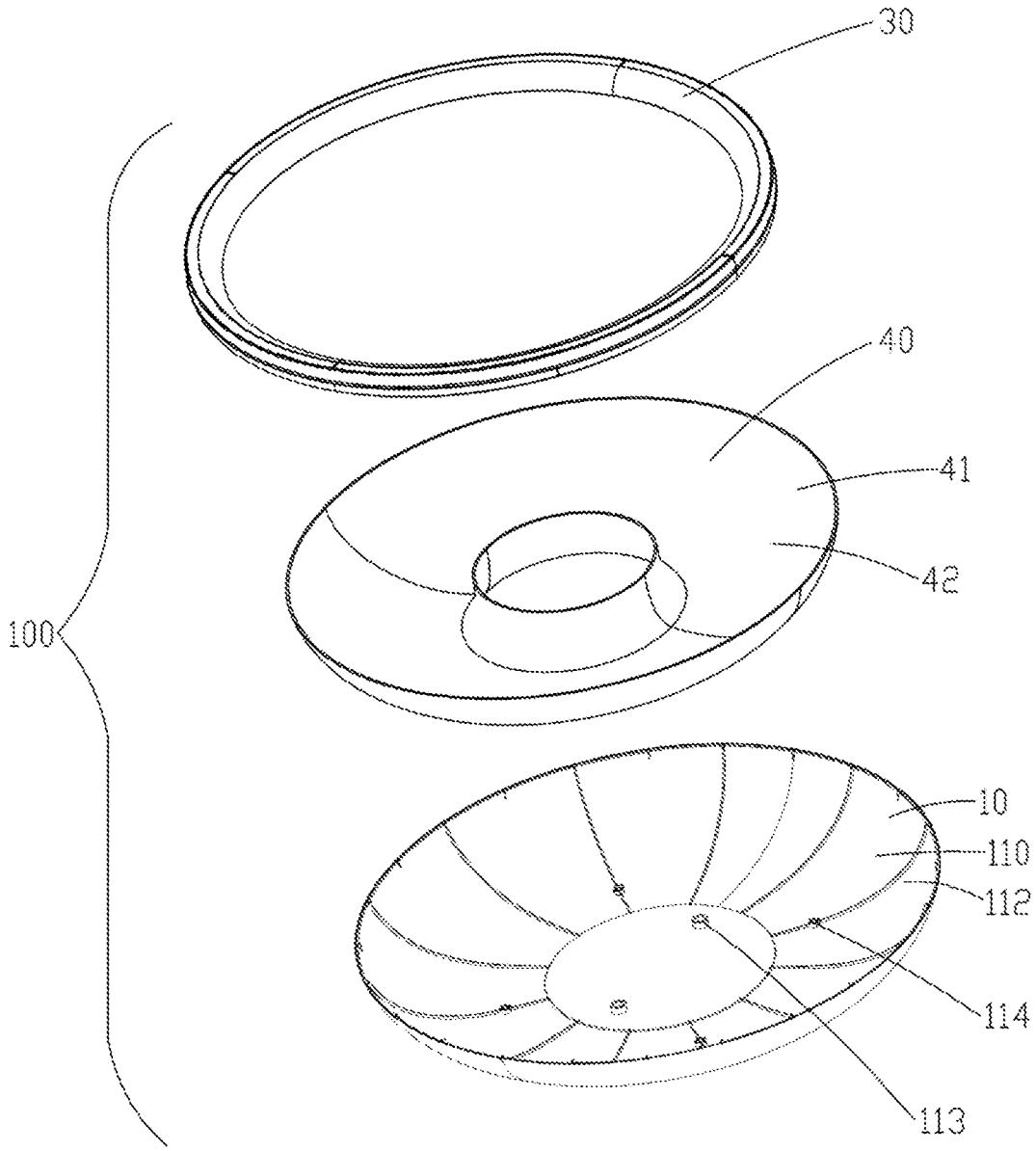
FIG. 4 is an exploded view of FIG. 3 from another perspective.
Figure 8:
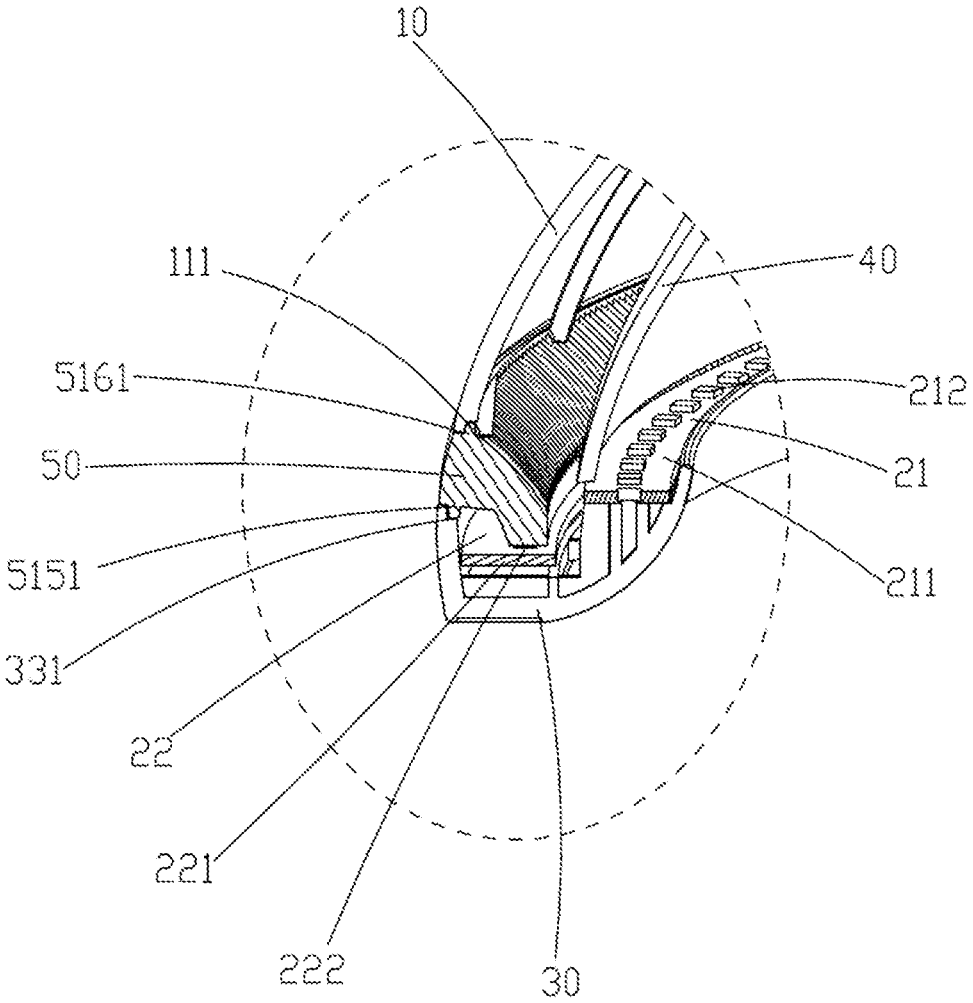
FIG. 8 is an elevation view of the circle in FIG. 7.

As illustrated in FIGS. 3, 4 and 8, the mounting cover 10 is a semi-open cover and is provided with an opening 110 and an accommodating cavity 112; a first recess 111 for positioning the second light distribution element 50 is formed on an inner side of an end portion of the mounting cover. A plurality of connecting holes 113 and mounting holes 114 are formed on the top of the mounting cover 10. More specifically, the connecting holes 113 are configured to connect the mounting cover 10 with the first light distribution element 40; the mounting holes 114 are configured to connect the illuminating device 100 with a mounting base such as a metal hanger (not illustrated), and the illuminating device is fixed on the ceiling through the metal hanger.

As illustrated in FIGS. 3 to 8, the base 30 is an annular structure, and includes an annular bottom wall 31, and an inner wall 32 and an outer wall 33 which are extended upwards from two sides of the bottom wall 31. The inner wall 32 is a cambered wall and is provided with a first mounting surface (not marked) and a plurality of first mounting columns 321 for fixing the first light source component 21. The bottom wall 31 is provided with a second mounting surface (not marked) and a plurality of second mounting columns 311 for fixing the second light source component 22. In the present example, a plurality of first protrusions 312 are extended upwards from the bottom wall 31, and the first protrusions 312 form the first mounting surface; and a plurality of second protrusions 322 are extended inwards from the inner wall 32, and the second protrusions 322 form the second mounting surface. In other alternative examples, the first mounting surface and the second mounting surface may also be formed by structures in other forms. A second recess 331 for positioning the second light distribution element 50 is formed on an end surface of the outer wall 33.

As illustrated in FIGS. 5 to 8, the light source module 20 includes a first light source component 21 and a second light source component 22 both mounted on the base 30. The first light source component 21 and the second light source component 22 are ring-shaped and concentric. In the present example, the first light source component 21 and the second light source component 22 are arranged in a stepped manner; the first light source component 21 is disposed at an inner side of the second light source component 22; and a plane provided with the first light source component 21 is higher than a plane provided with the second light source component 22. The first light source component 21 is directly mounted on the base 30 through screws (not illustrated). More specifically, the first light source component 21 includes a first substrate 211 and light emitting units 212 disposed on one side of the first substrate 211, and the screws (not illustrated) run through the first substrate 211 and are accommodated in the first mounting columns 321. The first substrate 211 may be formed by a plurality of cambered substrates (not marked) connected in an end-to-end manner, and may also be an integral annular substrate.

The second light source component 22 is fixed on the base 30. More specifically, the second light source component 22 includes a second substrate 221 and light emitting units 222 disposed on one side of the second substrate 221; screws (not illustrated) run through the second substrate 221 and are accommodated in the second mounting columns 311; the second light distribution element 50 is fixedly connected with the base 30; and an abutted portion (not illustrated) is disposed on a lower side of the second light distribution element 50 and is configured to allow the second substrate 221 to be abutted against the base 30, that is, the second light source component 22 is indirectly fixed on the base 30 through the second light distribution element 50.

As illustrated in FIGS. 3 and 4, the first light distribution element 40 is a reflector 41 and is accommodated in the accommodating cavity 112. The reflector 41 is annular and is provided with an annular optical cavity 42. Light of the first light source component 21 is emitted from the lower part of the illuminating device 100 after being reflected by the reflector 41. The reflector 41 is connected with the mounting cover 10 through screws (not illustrated). A bottom side of an outer ring of the reflector 41 is fastened with the inner side of the base 30 in a snap-fit manner. The connecting part of the reflector 41 is not illustrated in the figures.

Figure 5:
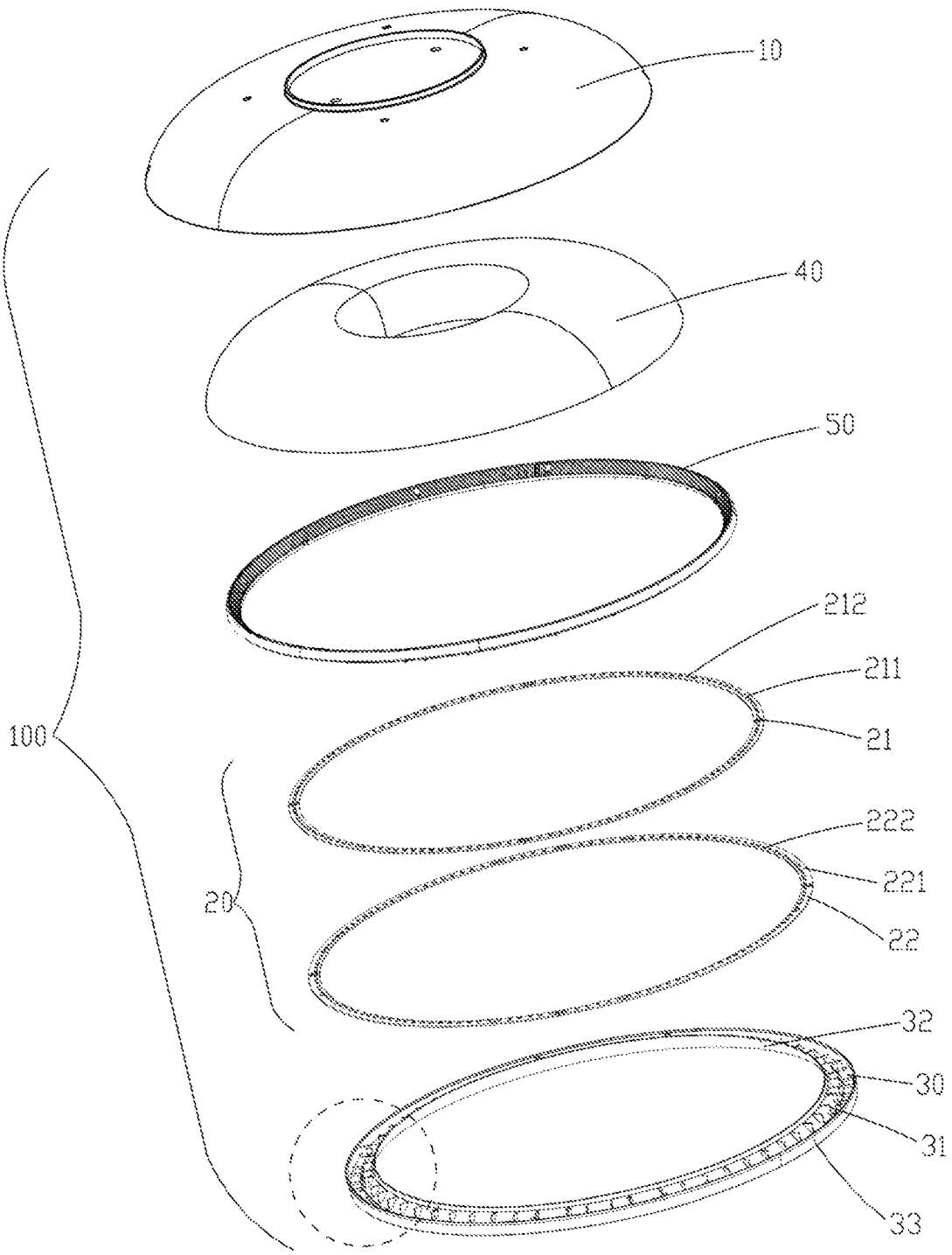
FIG. 5 is a completely exploded view of an illuminating device provided by the present disclosure.
Figure 6:
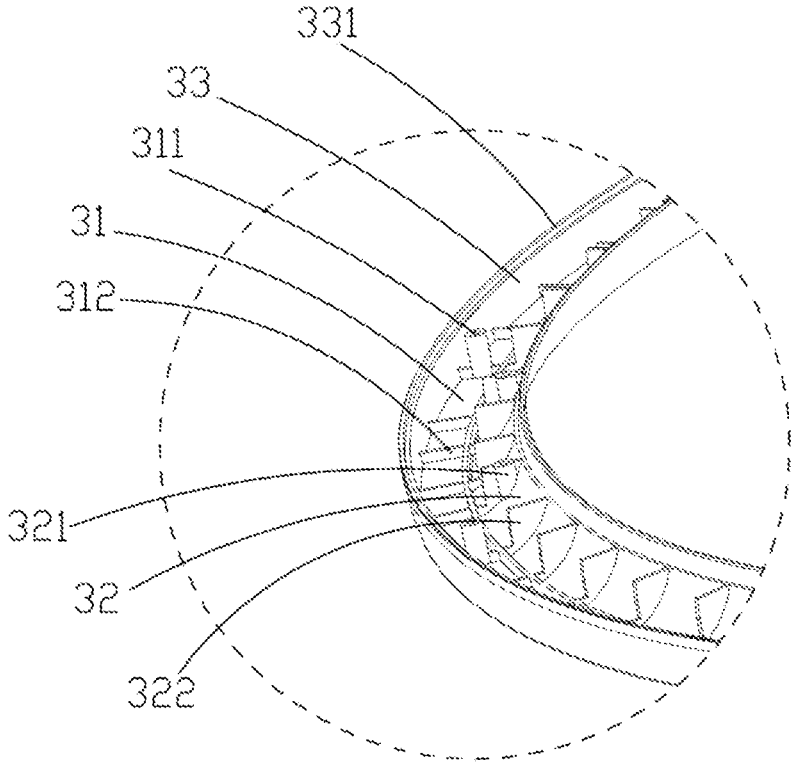
FIG. 6 is an enlarged view of the circle in FIG. 5.
Figure 7:
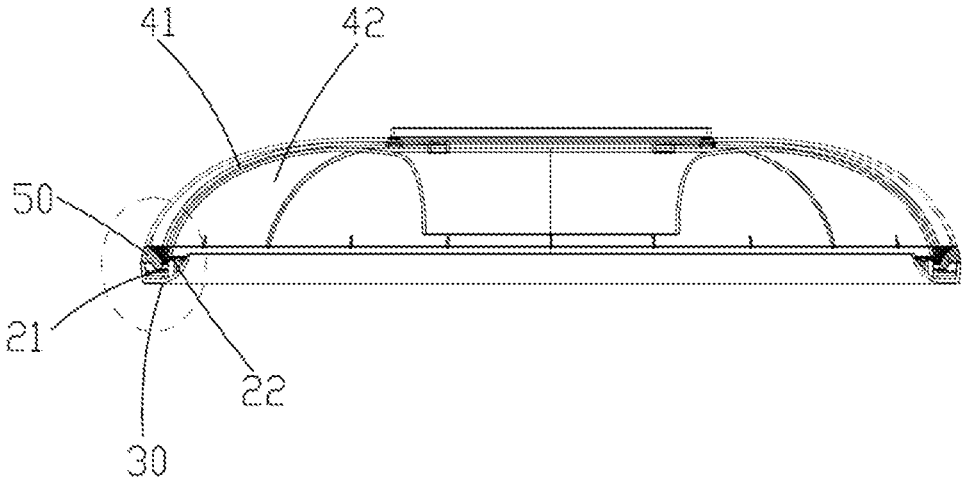
FIG. 7 is a sectional view of FIG. 1 along the A-A line.
Figure 10:
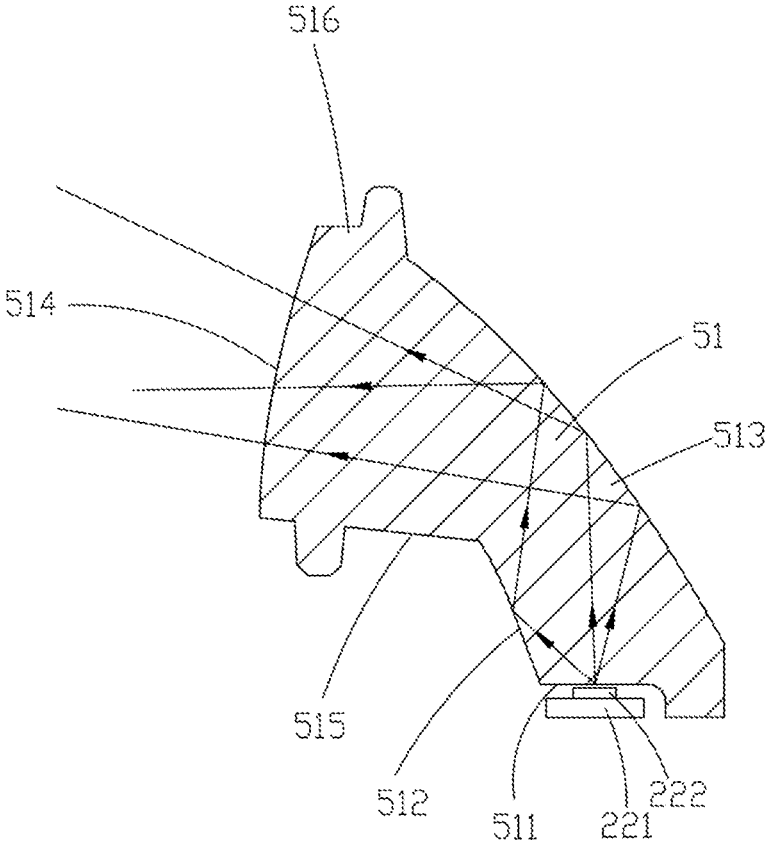
FIG. 10 is a sectional view of FIG. 9.

As illustrated in FIGS. 3, 5 and 10, the second light distribution element 50 is an annular lens and is formed by multiple sections of a cambered lens 51, and a material of the lens may be polymethyl methacrylate (PMMA) or polycarbonate (PC). A wall surface of the lens 51 includes a light incident surface 511, a light emitting surface 514, and a first reflecting surface 512 and a second reflecting surface 513 disposed on both sides of the light incident surface 511. As illustrated in FIG. 10, a size of the second light source component 22 is equivalent to a length of the second light distribution element 50, namely a circumference of the second light source component 22 is as same as a circumference of the second light distribution element 50, and a width of the light emitting units 222 is less than a width of the light incident surface 511 so that all the light emitted by the light emitting units 222 of the second light source component 22 enters the lens 51 from the light incident surface 511; one part of the light is directly emitted from the light emitting surface 514 after being reflected by the second reflecting surface 513; another part of the light is reflected to the second reflecting surface 513 by the first reflecting surface 512, reflected by the second reflecting surface 513, and then emitted from the light emitting surface 514; and still another part of the light that does not meet a total reflection angle is directly transmitted through the lens 51, but the transmitted light occupies small proportion. In the present example, the light incident surface 511 is a plane surface; the first reflecting surface 512 and the second reflecting surface 513 are cambered surfaces and are also total reflection surfaces, in which the second reflecting surface 513 may be a smooth wall surface or an electroplated reflecting surface. The light emitting surface 514 is a cambered surface, and is a smooth wall surface or a frosted surface. In other alternative examples, the first reflecting surface 512 and the second reflecting surface 513 may also have a certain transmission ratio (transmittance). The light emitting surface 514 may also be a plane surface. When the light emitting surface 514 is a plane surface, there is an included angle of 15° between the light emitting surface 514 and a vertical plane. When it needs to make a small-sized lens, a length of the lens may be less than 10 mm.

The lens 51 utilizes total reflection to adjust an optical path, so that emergent light has a larger polarization angle, a longer propagation distance and satisfies the requirements of high uniformity.

Figure 9:
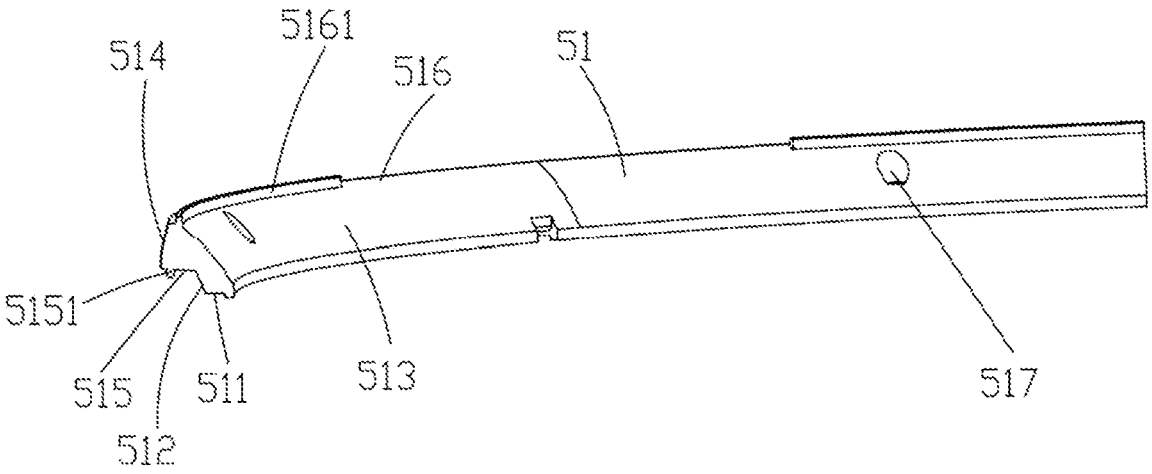
FIG. 9 is a schematic diagram of a lens in an illuminating device provided by an example of the present disclosure.

As illustrated in FIGS. 9 and 10, in order to conveniently position the lens 51 in the illuminating device 100, the wall surface of the lens 51 further includes a first connecting surface 515 that connects the first reflecting surface 512 with the light emitting surface 514, and a second connecting surface 516 that connects the second reflecting surface 513 with the light emitting surface 514. The first reflecting surface 512 and the first connecting surface 515 allow a cross section of the lens 51 to be formed with a notch (not marked). A first lug 5151 is provided on the first connecting surface 515 along the extension direction of the lens 51. A second lug 5161 is provided on the second connecting surface 516 along the extension direction of the lens 51. The first lug 5151 on the first connecting surface 515 and the second lug 5161 on the second connecting surface 516, each, may be an integral lug and may also be multiple lugs arranged at intervals. In the present example, the first connecting surface 515 and the second connecting surface 516 neither reflect light nor emit light.

As illustrated in FIGS. 5 to 10, in order to conveniently connect the lens 51 with other components in the illuminating device 100, the lens 51 is also provided with a through hole 517 running through the lens 51. The through hole 517 runs through the second reflecting surface 513 and the light incident surface 511. In the mounting process, the second light source component 22 runs through the second mounting columns 311 and is positioned on the base 30 at first, and then the screws (not illustrated) run through the through hole 517 and are accommodated in the second mounting columns 311 of the base 30, so as to realize the connections among the lens 51, the second light source component 22 and the base 30, in which the first lug 5151 is accommodated in the second recess 331 of the base 30.

In the mounting process, the reflector 41 is mounted on the mounting cover 10 by screwed connection at first. After the first light source component 21, the lens 51 and the second light source component 22 are connected with the base 30, the light source module is formed. After the light source module is fastened with the reflector 41 in a snap-fit manner, the assembling process of the entire illuminating device 100 can be finished, in which the second lug 5161 is accommodated in the first recess 111 of the mounting cover 10. The positioning of the first lug 5151 and the second lug 5161 prevents the lens 51 from moving in the illuminating device 100.

By adopting the above assembling method, the light emitting surface 514 of the second light distribution element 50 is exposed on the outside of the reflector 41 and provides light obliquely upwards. The illuminating device 100 adopts a combination of the first light source component 21 and the reflector 41 for direct lighting, and adopts a combination of the second light source component 22 and the lens 51 for ceiling lighting. Users can select the desired lighting solution according to their own demands. In the present example, the illuminating device 100 is a circular ceiling lamp, and the first light distribution element 40 is an annular lens. In other alternative examples, the illuminating device 100 may be a square ceiling lamp, and the lens 51 is adaptively adjusted to be an extendable lens in a straight shape.

According to the optical principle of the lens 51, the structure of the lens 51 can be adaptively modified to obtain different examples. From the present example, the following three further examples are provided.

Figure 11:
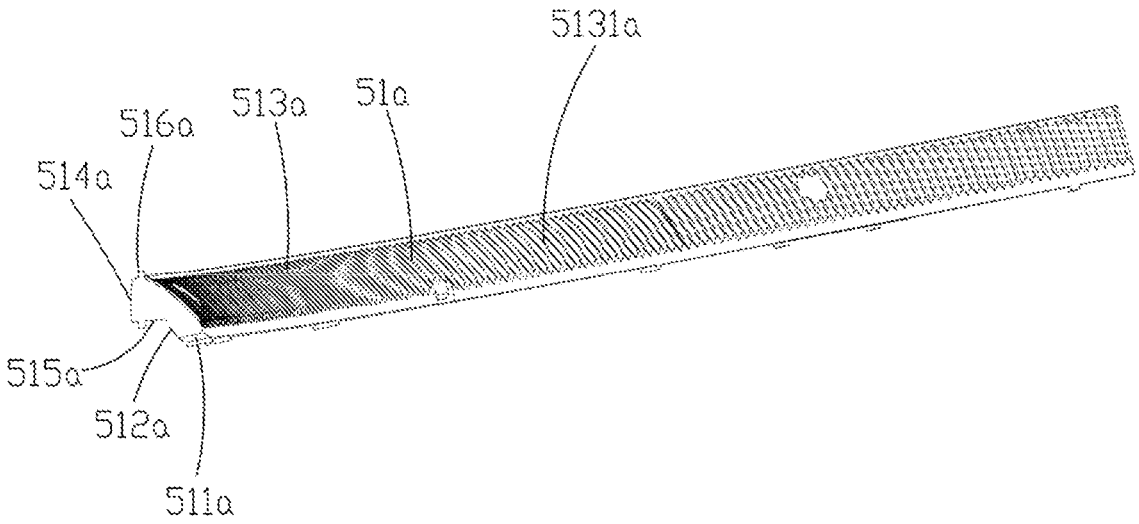
FIG. 11 is a schematic diagram of a lens in an illuminating device provided by another example of the present disclosure.

First example: as illustrated in FIG. 11, the present disclosure provides a lens 51*a*. The structure of the lens 51*a* is basically the same with the structure of the lens 51. More specifically, a wall surface of the lens 51*a* includes a light incident surface 511*a*, a light emitting surface 514*a*, a first reflecting surface 512*a* and a second reflecting surface 513*a* disposed on two sides of the light incident surface 511*a* respectively, a first connecting surface 515*a* that connects the first reflecting surface 512*a* with the light emitting surface 514*a*, and a second connecting surface 516*a* that connects the second reflecting surface 513*a* with the light emitting surface 514*a*.

The structural differences between the lens 51*a* and the lens 51 lie in that: the second reflecting surface 513*a* includes a plurality of continuously arranged zigzag structures 5131*a*; two ends of each of the zigzag structures 5131*a* are extended along the up and down directions of the lens 51*a*; each of the zigzag structures 5131*a* includes two intersected, reflecting surfaces; and an included angle between the two reflecting surfaces is 60° to 150°.

The arrangement of the zigzag structures 5131*a* on the second reflecting surface 513*a* of the lens 51*a* can improve the uniformity of light emitted from the lens 51*a* and avoids the phenomenon that the light emitted from the lens 51*a* forms light spots on a light receiving surface such as the ceiling.

Figure 12:
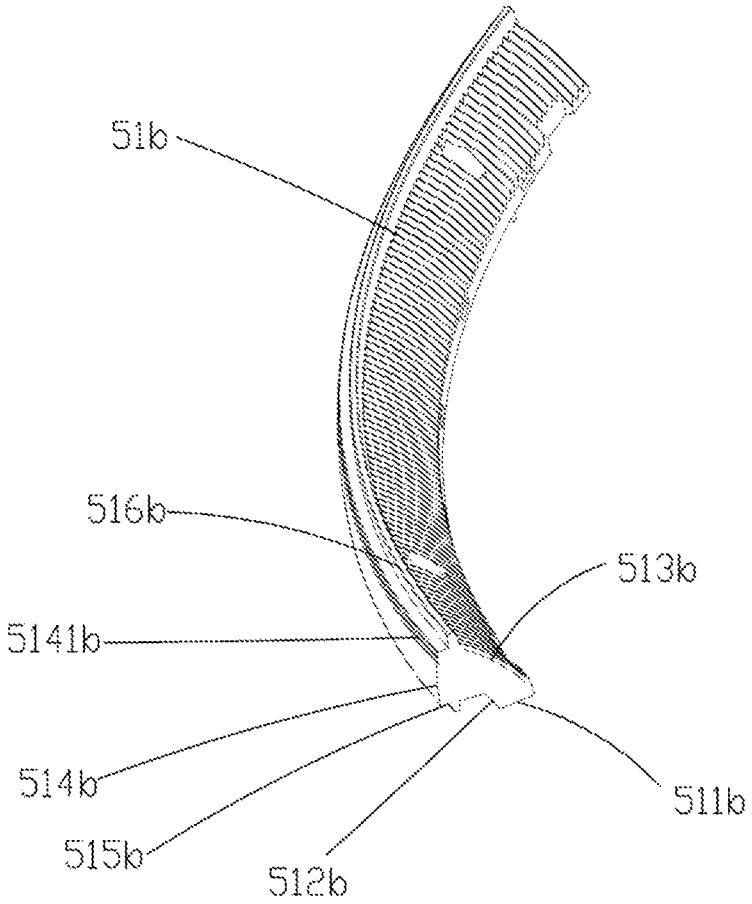
FIG. 12 is a schematic diagram of a lens in an illuminating device provided by still another example of the present disclosure.

Second example: as illustrated in FIG. 12, the present disclosure provides a lens 51*b*, and the structure of the lens 51*b* is basically the same with the structure of the lens 51. More specifically, a wall surface of the lens 51*b* includes a light incident surface 511*b*, a light emitting surface 514*b*, a first reflecting surface 512*b* and a second reflecting surface 513*b* disposed on two sides of the light incident surface 511*b* respectively, a first connecting surface 515*b* that connects the first reflecting surface 512*b* with the light emitting surface 514*b*, and a second connecting surface 516*b* that connects the second reflecting surface 513*b* with the light emitting surface 514*b*.

The structural differences between the lens 51*b* and the lens 51 lie in that: a plurality of continuous zigzag structures 5141*b* is disposed on the light emitting surface 514*b*, and two ends of each of the zigzag structures 5141*b* are extended along the extension direction of the lens 51*b*.

Figure 13:
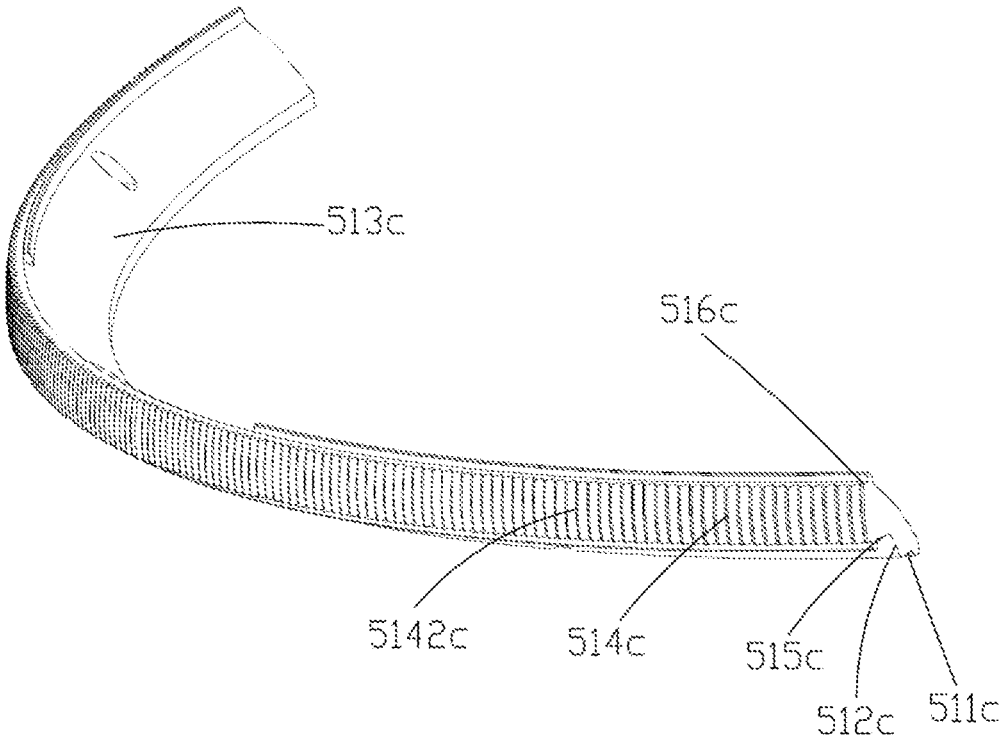
FIG. 13 is a schematic diagram of a lens in an illuminating device provided by yet another example of the present disclosure.

Third example: as illustrated in FIG. 13, the present disclosure provides a lens 51*c*, and the structure of the lens 51*c* is basically the same with the structure of the lens 51. More specifically, a wall surface of the lens 51*c* includes a light incident surface 511*c*, a light emitting surface 514*c*, a first reflecting surface 512*c* and a second reflecting surface 513*c* disposed on two sides of the light incident surface 511*c* respectively, a first connecting surface 515*c* that connects the first reflecting surface 512*c* with the light emitting surface 514*c*, and a second connecting surface 516*c* that connects the second reflecting surface 513*c* with the light emitting surface 514*c*.

The structural differences between the lens 51*c* and the lens 51 lie in that: the light emitting surface 514*c* includes a plurality of continuously arranged zigzag structures 5142*c*; two ends of each of the zigzag structures 5142*c* are extended along the up and down directions of the lens 51*c*; and the light emitting surface 514*c* may be a mirror surface or a frosted surface.

In summary, the lens provided by the present disclosure utilizes total reflection to adjust the optical path, so that the emergent light has a larger polarization angle, a longer propagation distance and can meet the requirement of high uniformity. The illuminating device provided by the disclosure employs the lens to distribute light for the second light source component to achieve the purpose of ceiling lighting, so that the illuminating device not only has the function of direct lighting but also has an independent function of ceiling lighting.

The present disclosure provides a lens capable of achieving large emission angle and uniform light emission.

The present disclosure provides a lens. The lens is an extendable lens and includes: a light incident surface, a light emitting surface, and a first reflecting surface and a second reflecting surface disposed on two sides of the light incident surface respectively. Light that enters the lens from the light incident surface at least includes: a first part which is reflected by the second reflecting surface and then directly emits from the light emitting surface; and a second part which is reflected to the second reflecting surface by the first reflecting surface, then reflected by the second reflecting surface, and then emits from the light emitting surface.

Further, the light incident surface is a plane surface.

Further, the second reflecting surface is a cambered surface.

Further, the light emitting surface is a cambered surface or a plane surface; and when the light emitting surface is a plane surface, an included angle of 15° is formed between the light emitting surface and a vertical plane.

Further, a length of the lens is less than 10 mm.

Further, a wall surface of the lens further includes a first connecting surface which connects the first reflecting surface with the light emitting surface.

Further, the first reflecting surface and the first connecting surface allow a cross section of the lens to be formed with a notch.

Further, a first lug is provided on the first connecting surface along an extension direction of the lens.

Further, the wall surface of the lens further includes a second connecting surface which connects the second reflecting surface with the light emitting surface.

Further, a second lug is provided on the second connecting surface along an extension direction of the lens.

Further, the lens is also provided with a through hole which runs through the lens; and the through hole runs through the second reflecting surface and the light incident surface.

Further, the second reflecting surface includes a plurality of continuously arranged zigzag structures; and two ends of each of the zigzag structures are extended along an up and down direction of the lens.

Further, the light emitting surface is provided with a plurality of continuously arranged zigzag structures.

Further, two ends of each of the zigzag structures are extended along an extension direction or an up and down direction of the lens.

Further, each of the zigzag structures includes two intersected wall surfaces; and an included angle between the two wall surfaces is 60°-150°.

Further, two wall surfaces of each of the zigzag structures are smooth wall surfaces or frosted surfaces.

The present disclosure further provides an illuminating device, including: a base; a first light source component and a second light source component both fixed on the base; a first light distribution element disposed above the first light source component; a second light distribution element disposed above the second light source component; and a mounting cover connected with the base. The second light distribution element includes at least one section of the lens described above; and an area covered by emergent light of the second light source component after light distribution and an area covered by emergent light of the first light source component after light distribution are different areas.

Further, the mounting cover is a semi-open cover and is provided with an opening and an accommodating cavity.

Further, the first light source component and the second light source component are both annular and are arranged in a stepped manner.

Further, the first light distribution element is a reflector which is accommodated in the accommodating cavity.

Further, the lens is connected with the base; and the second light source component is fixed between the lens and the base.

Further, the second light source component includes a base and a plurality of light emitting units disposed on one side of the base; and a size of a light incident surface of the second light distribution element is equivalent to a size of the second light source component.

Further, the light emitting surface of the lens is disposed at an outer side of the first light distribution element.

The present disclosure also provides a method of utilizing a lens that can be extendable. The method may include providing a light incident surface and a light emitting surface; and disposing a first reflecting surface and a second reflecting surface on two sides of the light incident surface; and when light enters the lens from the light incident surface, reflecting a first part of the light by the second reflecting surface and then directly emitting from the light emitting surface, and reflecting a second part of the light to the second reflecting surface by the first reflecting surface then by the second reflecting surface and then emitting from the light emitting surface.

Compared with other implementations, the lens provided by the present disclosure utilizes total reflection to adjust the optical path, so that the emergent light has larger polarization angle, longer propagation distance and satisfies the requirements of high uniformity. The illuminating device provided the present disclosure employs the lens to distribute light for the second light source component to achieve the purpose of ceiling lighting, so the illuminating device not only has an optical structure for direct lighting but also has an independent optical structure for ceiling lighting. Users can choose the desired lighting solution according to their own demands.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The objectives, the technical solutions and the beneficial advantages of the present disclosure have been described in details with reference to the above particular examples. It should be understood that, the above are only specific implementations of the present disclosure, and the protection scope of the present disclosure is not limited thereto. Any modifications, substitutions and improvements that easily occur to those skilled in the art within the spirit and principle of the present disclosure should be fallen within the protection scope of the present disclosure.

What is claimed is:

1. A lens, comprising:

a light incident surface, a light emitting surface, and a first reflecting surface and a second reflecting surface disposed on two sides of the light incident surface, and wherein:

light that enters the lens from the light incident surface at least comprises: a first part which is reflected by the second reflecting surface and then directly emits from the light emitting surface, and a second part which is reflected to the second reflecting surface by the first reflecting surface then reflected by the second reflecting surface and then emits from the light emitting surface, wherein the light emitting surface is provided with a plurality of continuously arranged zigzag structures, wherein the zigzag structures are disposed on the light emitting surface and are arrange along an extension direction of the lens, wherein a wall surface of the lens comprises a first connecting surface which connects the first reflecting surface with the light emitting surface, and wherein a first lug is provided on the first connecting surface along an extension direction of the lens.

2. The lens according to claim 1, wherein the light incident surface is a plane surface.

3. The lens according to claim 1, wherein the second reflecting surface is a cambered surface.

4. The lens according to claim 1, wherein:

the light emitting surface is a cambered surface or a plane surface; and when the light emitting surface is a plane surface, an included angle of 15° is formed between the light emitting surface and a vertical plane.

5. The lens according to claim 1, wherein a length of the lens is less than 10 mm.

6. The lens according to claim 1, wherein the first reflecting surface and the first connecting surface allow a cross section of the lens to be formed with a notch.

7. The lens according to claim 1, wherein:

the lens is also provided with a through hole which runs through the lens; and the through hole runs through the second reflecting surface and the light incident surface.

8. The lens according to claim 1, wherein two ends of each of the zigzag structures are extended along an extension direction or an up and down direction of the lens.

9. The lens according to claim 1, wherein a wall surface of the lens further comprises a connecting surface which connects the second reflecting surface with the light emitting surface.

10. The lens according to claim 9, wherein a second lug is provided on the connecting surface along an extension direction of the lens.

11. The lens according to claim 1, wherein:

the second reflecting surface comprises a plurality of continuously arranged zigzag structures; and two ends of each of the zigzag structures are extended along an up and down direction of the lens.

12. The lens according to claim 11, wherein:

each of the zigzag structures comprises two intersected wall surfaces; and an included angle between the two wall surfaces is 60°-150°.

13. The lens according claim 11, wherein two wall surfaces of each of the zigzag structures are smooth wall surfaces or frosted surfaces.

14. An illuminating device, comprising a base, a first light source component and a second light source component that are both fixed on the base, a first light distribution element disposed above the first light source component, a second light distribution element disposed above the second light source component, and a mounting cover connected with the base, wherein the second light distribution element comprises at least one section of a lens, wherein the lens comprises a light incident surface, a light emitting surface, and a first reflecting surface and a second reflecting surface disposed on two sides of the light incident surface, wherein: light that enters the lens from the light incident surface at least comprises: a first part which is reflected by the second reflecting surface and then directly emits from the light emitting surface, and a second part which is reflected to the second reflecting surface by the first reflecting surface then reflected by the second reflecting surface and then emits from the light emitting surface; and an area covered by emergent light of the second light source component after light distribution and an area covered by emergent light of the first light source component after light distribution are different areas, wherein the light emitting surface is provided with a plurality of continuously arranged zigzag structures, wherein the zigzag structures are disposed on the light emitting surface and are arrange along an extension direction of the lens, wherein a wall surface of the lens comprises a first connecting surface which connects the first reflecting surface with the light emitting surface, and wherein a first lug is provided on the first connecting surface along an extension direction of the lens.

15. The illuminating device according to claim 14, wherein the mounting cover is a semi-open cover and is provided with an opening and an accommodating cavity.

16. The illuminating device according to claim 15, wherein the first light source component and the second light source component are both annular and are arranged in a stepped manner.

17. A method of utilizing a lens, comprising:

providing a light incident surface and a light emitting surface; and disposing a first reflecting surface and a second reflecting surface on two sides of the light incident surface; and when light enters the lens from the light incident surface, reflecting a first part of the light by the second reflecting surface and then directly emitting from the light emitting surface, and reflecting a second part of the light to the second reflecting surface by the first reflecting surface then by the second reflecting surface and then emitting from the light emitting surface, wherein the light emitting surface is provided with a plurality of continuously arranged zigzag structures, wherein the zigzag structures are disposed on the light emitting surface and are arrange along an extension direction of the lens, wherein a wall surface of the lens comprises a first connecting surface which connects the first reflecting surface with the light emitting surface, and wherein a first lug is provided on the first connecting surface along an extension direction of the lens.

* * * * *